US008479943B2

(12) United States Patent
Wilhelm

(10) Patent No.: US 8,479,943 B2
(45) Date of Patent: Jul. 9, 2013

(54) SHEET-MATERIAL PIERCER FOR A CONTAINER CLOSURE

(76) Inventor: René Wilhelm, Luetisburg Station (CH)

( * ) Notice: Subject to any disclaimer, the term of this patent is extended or adjusted under 35 U.S.C. 154(b) by 308 days.

(21) Appl. No.: 12/734,265

(22) PCT Filed: Oct. 16, 2008

(86) PCT No.: PCT/CH2008/000435

§ 371 (c)(1),
(2), (4) Date: Apr. 21, 2010

(87) PCT Pub. No.: WO2009/052642

PCT Pub. Date: Apr. 30, 2009

(65) Prior Publication Data

US 2010/0237075 A1 Sep. 23, 2010

(30) Foreign Application Priority Data

Oct. 22, 2007 (CH) ..... 1644/07

(51) Int. Cl.
*B65D 17/30* (2006.01)

(52) U.S. Cl.
USPC ..... 220/267; 220/270; 220/284; 222/83; 222/83.5; 222/129; 222/145; 222/521; 222/525; 215/228; 206/219

(58) Field of Classification Search
USPC ..... 215/228; 220/267, 284, 270; 222/83, 222/83.5, 129, 145.5, 521, 525; 206/219
See application file for complete search history.

(56) References Cited

U.S. PATENT DOCUMENTS

2004/0155061 A1* 8/2004 Roth et al. ..... 222/145.5
2008/0067172 A1 3/2008 Wilhelm

FOREIGN PATENT DOCUMENTS

WO WO 2006/099768 9/2006

OTHER PUBLICATIONS

International Search Report.

* cited by examiner

*Primary Examiner* — Anthony Stashick
*Assistant Examiner* — Elizabeth Volz
(74) *Attorney, Agent, or Firm* — Collard & Roe, P.C.

(57) ABSTRACT

A sheet-material piercer (1) for a container closure (2) of the push-pull type is of essentially rotationally symmetrical design and can be inserted into the container closure (2) in the direction of the axis of rotation of symmetry (R) such that it can be displaced axially independently of the push-pull part of the container closure (2). The sheet-material piercer (1) is in one piece and has at least one sealing formation (16, 17, 18) which is likewise of rotationally symmetrical design and is arranged between an actuating end (13) and a piercing end (14). The sealing formation (16, 17, 18) is designed for sealing and latching contact with the container closure (2). Also proposed is a container closure (2) for a container (3) with a so-called push-pull closure and such a sheet-material piercer (1).

8 Claims, 4 Drawing Sheets

SHEET-MATERIAL PIERCER FOR A CONTAINER CLOSURE

CROSS REFERENCE TO RELATED APPLICATIONS

Figure 1:
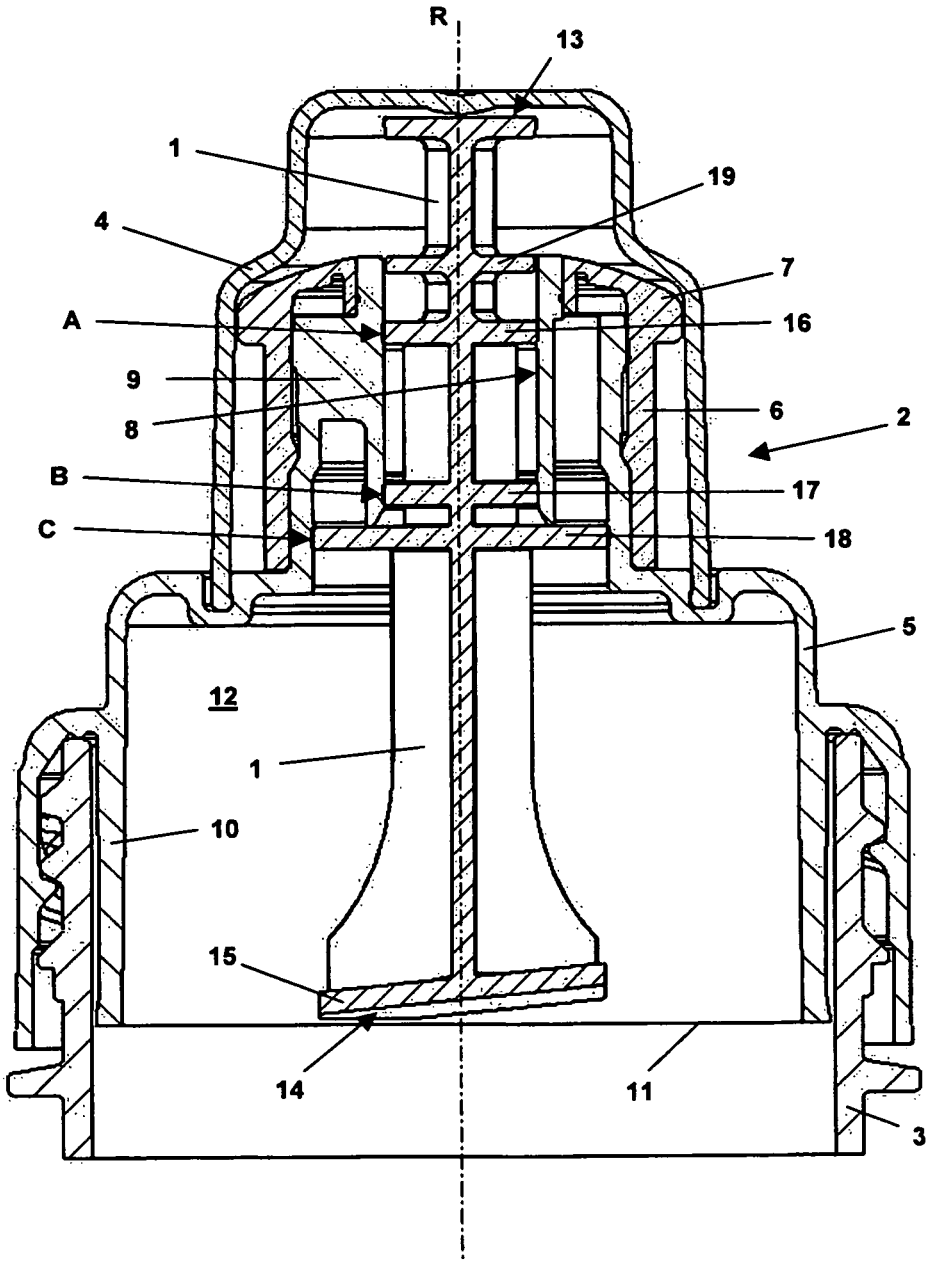

This application is the National Stage of PCT/CH2008/000435 filed on Oct. 16, 2008, which claims priority under 35 U.S.C. §119 of Swiss Application No. 1644/07 filed on Oct. 22, 2007. The international application under PCT article 21(2) was not published in English.

The invention relates to a sheet-material piercer for a container closure according to patent claim 1 and a container closure having a sheet-material piercer according to the invention according to patent claim 6.

Sheet-material piercers of this type can be used in container closures of the push-pull type which are fitted with an additional chamber (8) for storing a substance of liquid or powdery consistency.

In the field of sports drinks, but increasingly also in ever wider sectors of the market, there is a rapidly increasing requirement to be able to supply vitaminised or otherwise enriched drinks in suitable containers. There is also a clear trend to only add these additives immediately before use. Drinks bottles that can be operated with one hand are frequently preferred. Drinks bottles with so-called "push-pull" closures are suitable for this purpose. Such drinks bottles can not only be easily opened but can also be closed again after use by simply pressing with the thumb.

WO 2006/099768 discloses a container closure for a container having a so-called "push-pull" closure. This container closure has a cover part with a sealing lip which can be placed around a container opening and a sliding part attached in a displaceable manner to the cover part (for actuating the push-pull), wherein an outflow opening can be released or closed by displacing the sliding part on the cover part. A tearable or piercable closure film is attached to the sealing lip, wherein an additional chamber which is tightly separated in relation to the contents of the container is formed in the inner chamber of the cover part facing the sliding part. A film piercer (consisting of a pin and a tearing and piercing device) is also attached displaceably in the cover part, wherein by actuating the film piercer the closure film can be torn open or pierced and whereby an additive which can be introduced into the additional chamber can enter into the container. A disadvantage of this film piercer is that it is constructed in two parts which makes manufacture and assembly of a container closure fitted with this more expensive and more complex.

It is therefore the object to provide an improved sheet-material piercer for a container closure of the 'push-pull' type and a container closure having a corresponding sheet-material piercer.

This object is achieved by the features of patent claims 1 and 6.

The solution consists in that the sheet-material piercer is in one piece and has at least one sealing formation which is arranged between an actuating end and a piercing end and is configured for sealing and latchable contact with the container closure.

In a container closure for a container having a so-called 'push-pull' closure and a sheet-material piercer according to the invention, the sheet-material piercer can be inserted in a sealing and latching manner into the cover part.

This therefore comprises an improvement of a generic container closure according to the prior art which was mentioned initially and described in WO 2006/099768.

The main advantage of the sheet-material piercer according to the invention is its one-piece nature. In addition to being easier to manufacture, it is also achieved with the proposed solution that during assembly of the container closure, the sheet-material piercer only needs to be pressed into the cover part from below and latches therein. Assembly is therefore simplified.

The at least one sealing formation arranged between the actuating end and the piercing end which is configured for sealing and latchable contact with the container closure makes it possible to achieve the aforementioned latching positioning of the sheet-material piercer in the container closure.

Sealing formation in this case means constructive features by which means a sealing effect is primarily achieved. In the present case, this can be achieved by a shaping which effects a snug and tight fit at the sealing point, that is for example, using the natural elasticity and stiffness of the materials used. The general term 'sealing formation' was selected because, as is familiar to the person skilled in the art, these features in kinematic reversal can in principle frequently be achieved in two complementary manners. Thus, correspondingly shaped circular sealing webs can either be provided on the sheet-material piercer or on the cover part. However, since the sealing effect always requires a cooperation of parts (e.g. sealing web and sealing seat), it is preferably called a sealing formation at the relevant position.

For the purpose of saving material the at least one sealing formation can be designed to be plate-like and for better guidance of the sheet-material piercer in the cover part, two such circular sealing formations can be provided with the same circle diameters. Three circular plate-like sealing formations are particularly advantageous because a good seal of the additional chamber towards the outside is thus possible in the initial position (the sheet-material piercer is not yet activated). In particular, liquid additives are then particularly well protected.

A substantially slightly beveled plate at the piercing end of the sheet-material piercer is also particularly advantageous. The plate can then have a simple geometrical shape, for example, square. The closure film is reliably pierced by the obliquely projecting edge and the plate area guarantees that the piercing hole in the film is sufficiently large that the additive enters the container completely and rapidly.

Figure 2:
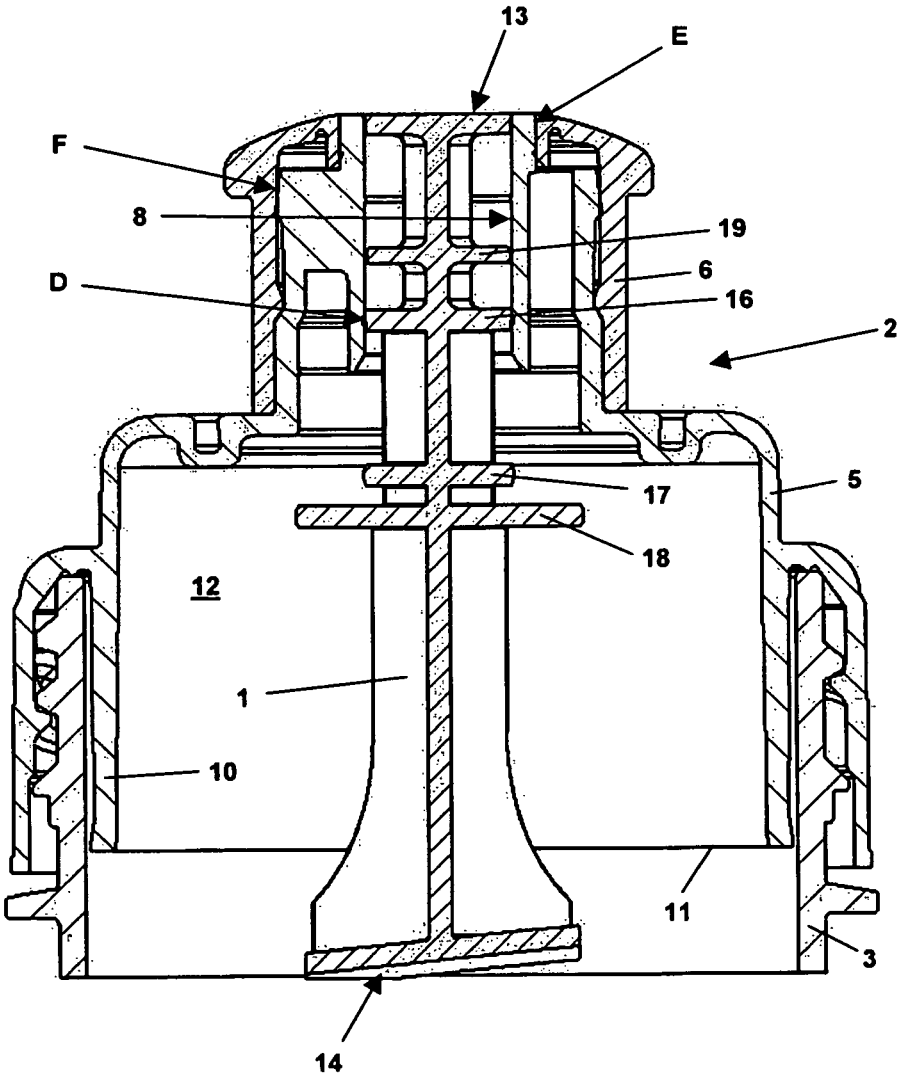
Figure 3:
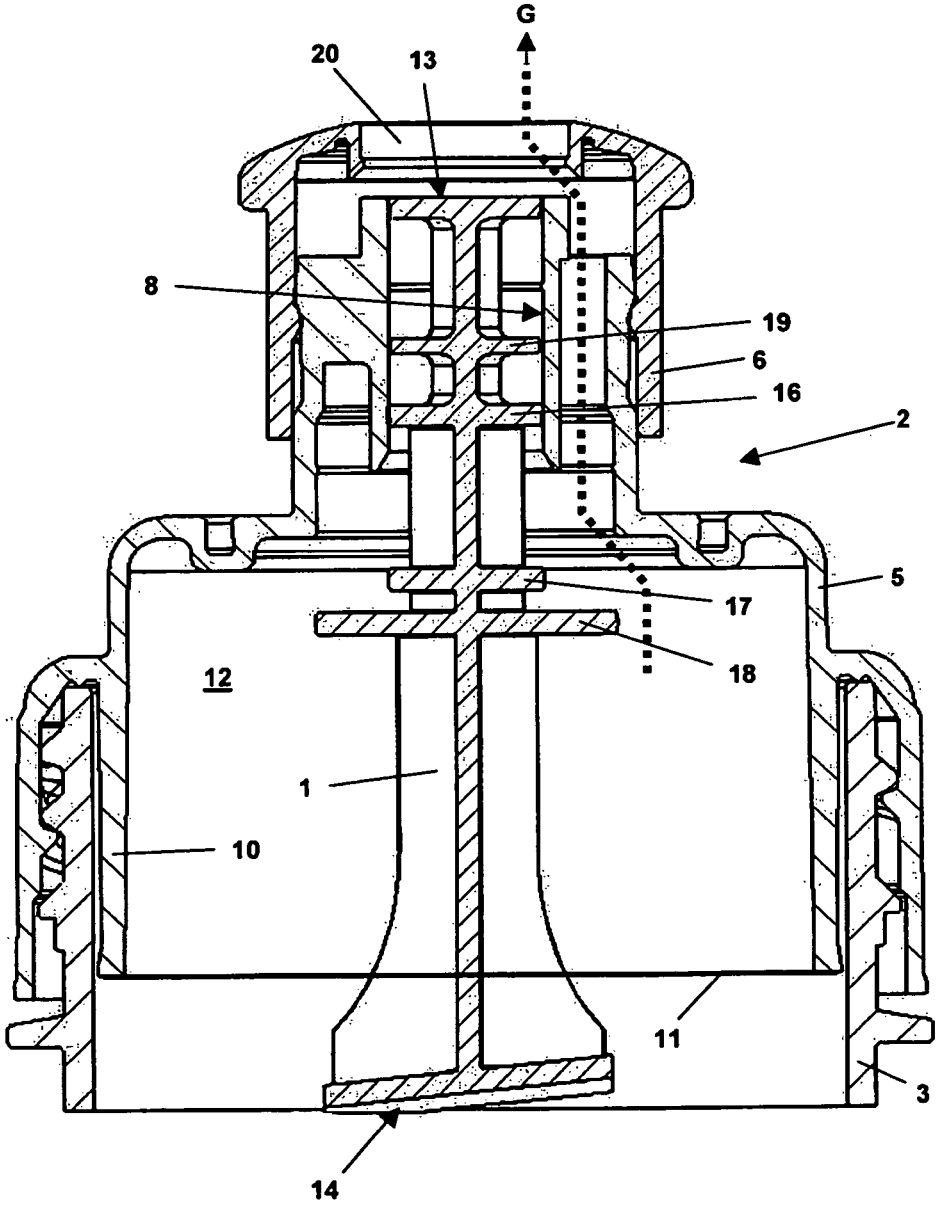
Figure 4:
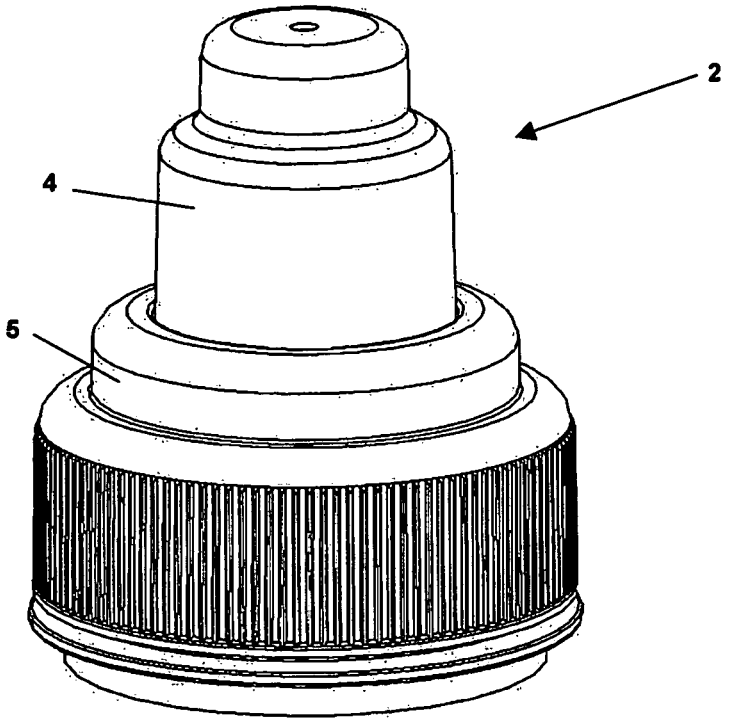

The invention is explained in detail hereinafter with reference to an exemplary embodiment. In the drawings:

FIG. 1 shows in cross-section a sheet-material piercer in a 'push-pull' container closure in the purchased state, FIG. 2 shows in cross-section a sheet-material piercer in a 'push-pull' container closure in the piercing state, FIG. 3 shows in cross-section a sheet-material piercer in a 'push-pull' container closure in the drinking state and FIG. 4 shows a 3D view of a container closure with protective cap placed thereon.

FIG. 1 shows in cross-section a sheet-material piercer 1 in a 'push-pull' container closure 2 in the purchased state or in its initial position. In this position, the 'push-pull' closure is closed and the sheet-material piercer 1 is not yet activated. The container closure 2 is in this case placed onto a container 3 and the 'push-pull' closure is covered by a protective cap 4 placed thereon.

The container closure 2 has a cover part 5 with a sliding part 6 placed thereon and displaceable on the cover part 5. The sliding part 6 in this case forms the actual 'push-pull' closure; i.e. it must be pushed or pulled into one or other position to close or open the container closure 2. As a result of the protruding bead such a closure is also suitable for one-handed operation. The container closure 2 further has the already-mentioned sheet-material piercer 1 in a central tube-like guide 8. On the one hand, for reasons of saving material, on the other hand in order not to unnecessarily reduce the liquid outlet cross-section, the guide 8 is advantageously connected to the other parts of the cover part 5 by means of radially arranged material bridges 9. In the present exemplary embodiment, three such material bridges 9 are provided.

The cover part 5 furthermore has a pulled-down lip 10 to which a closure film 11 is attached. In the intact state (and as long as the container closure 2 is placed on the container 3), the closure film 11 prevents any outflow of the container content. The closure film 11 creates an additional chamber 12 tightly separated in relation to the container contents in the inner chamber of the cover part 5 facing the sliding part 6. It is understood that the additional chamber 12 is larger, the further the lip 10 is pulled downwards.

The sheet-material piercer 1 is configured to be substantially rotationally symmetrical and as mentioned, arranged axially displaceably and centrally (i.e. in the direction of its axis of rotational symmetry R) in the container closure 2. The axial displaceability of the sheet-material piercer 1 is independent of the position of the push-pull part (that is of the sliding part 6) of the container closure 2.

The sheet-material piercer 1 has an actuating end 13 and a piercing end 14. The actuating end 13 is designed to be plate-like to facilitate convenient operation, for example, with the thumb of one hand. The piercing end 14 has a plate 15 arranged slightly at a slope. The plate 15 can then have a simple geometrical shape, for example, square. When pressing down the sheet-material piercer 1, the closure film 11 can then be reliably pierced by the lower obliquely protruding edge of this plate 15. The sheet-material piercer 1 as a whole has a substantially cross-like reinforcing profile in its axial longitudinal extension which again makes it possible to save material whilst having good strength.

The sheet-material piercer 1 furthermore has first and second plate-like circular sealing formations 16, 17 having the same circle diameter, which are arranged between the actuating end 13 and the piercing end 14. The first and the second sealing formations 16, 17 slide in the guide 8. Sealing points A and B are located at the contact points of the sealing formations 16 and 17 with the guide 8.

The sheet-material piercer 1 furthermore has a third plate-like circular sealing formation 18 which is likewise arranged between the actuating end 13 and the piercing end 14 but below the sealing formations 16 and 17. The third sealing formation 18 serves to close the entire outlet opening. A further sealing point C is therefore located at the contact point of the sealing formation 18 with the outflow tube of the cover part 5. A terminating plate 19 has no sealing function and merely serves for visual embellishment (clear termination in the unused state).

The sealing formations 16, 17, 18 or at least one thereof, are additionally configured in such a manner that in the position shown in FIG. 1 a latchable contact is formed between the sheet-material piercer 1 and the guide 8 in the cover part 5. This can be accomplished, for example, with suitably dimensioned latching grooves or notches. As a result of the disclosed manner of construction it is therefore possible to insert the sheet-material piercer 1 from below into the cover part 5 and make it latch in the position shown with some pressure.

An additive accommodated in the additional chamber, in particular a liquid, is therefore protected against outflowing. The sealing points A, B, C prevent any outflow to the outside, in particular through the opening in the guide 8. The (intact) closure film 11 prevents any outflow towards the inside. Even if the push-pull closure were opened in this position, the contents of the container 3 and also the contents of the additional chamber 12 therefore remain protected from flowing out.

FIG. 2 shows in cross-section a sheet-material piercer 1 in a 'push-pull' container closure 2 according to FIG. 1 in the piercing state or in an actuating position. In this position the 'push-pull' closure is still closed but the sheet-material piercer 1 is activated, i.e. it was pressed downwards and the addition of additive is thus accomplished.

In order to reach this position, the sheet-material piercer 1 was pushed downwards by means of pressure on the actuating end 13 to such an extent that it no longer protrudes. A latching function is also provided in this position, which for example can be provided on the first sealing formation 16 or on the second sealing formation 17. The torn-open closure film 11 is not shown here.

A sealing point D is now located at the contact point of the first sealing formation 16 with the guide 8. This prevents any outflow of the additive-mixed content from the container through the opening with the guide 8. Additional sealing points E and F are located at contact points of the sliding part 6 with the cover part 5. This prevents any outflow of the additive-mixed content out of the container from the still-closed push-pull closure.

In the position shown in FIG. 2 it would in principle still be possible to withdraw the sheet-material piercer 1 again by overcoming the latching force and releasing it completely from the cover part 5.

FIG. 3 shows in cross-section a sheet-material piercer 1 in a 'push-pull' container closure 2 according to FIG. 1 in the drinking state. In this position, the 'push-pull' closure is opened and the sheet-material piercer 1 is still activated. The container closure 2 is ready for drinking. The outflow path G is indicated by a direction arrow.

In order to reach this position, the sliding part 6 was pulled upwards. The content of the container 3 can then flow outwards via an outflow path G through a drinking opening 20.

FIG. 4 finally shows a 3D view of a container closure 2 according to the invention according to FIG. 1 with a protective cap 4 placed thereon.

Since the functionality and operation of a generic container closure 2 have already been described in detail in the prior art described initially (WO 2006/099768), reference is also made to this publication.

The invention claimed is:

1. A container closure (2) for a container (3) having a push-pull closure (6) capable of a push and pull motion, comprising a sheet-material piercer (1), which is configured to be substantially rotationally symmetrical about an axis of rotational symmetry (R) and is inserted in the container closure (2) so that the sheet-material piercer (1) is axially displaceable in the direction of the axis of rotational symmetry (R) independently from the push-pull closure, wherein the sheet-material piercer (1) is in one piece and has at least one sealing formation (16, 17, 18) which is likewise configured to be rotationally symmetrical about the axis of rotational symmetry (R) and is arranged between an actuating end (13) and a piercing end (14) of the sheet-material piercer (1) and is configured for sealing and latchable contact with the container closure (2), wherein the container closure (2) comprises a cover part (5) which can be attached around a container opening, the push-pull closure (6) being attached displaceably on the cover part (5) in such a manner that a drinking opening (20) can be released or closed by displacing the push-pull closure (6) on the cover part (5), wherein a tearable or piercable closure film (11) is attached to the cover part (5) so that the closure film (11) is firmly connected to the cover part (5) and an additional chamber (12) tightly separated from container content is formed in an inner chamber of the cover part (5) facing the push-pull closure (6), the additional chamber (12) of the container closure (2) being configured tightly for accommodating a substance of liquid or powdery consistency and the closure film (11) in an intact state preventing an outflow of the container content through the drinking opening (20), wherein the sheet-material piercer (1) is attached displaceably in the cover part (5) so that the sheet-material piercer (1) is moveable from a first position to a second position by an actuation of the sheet-material piercer (1), wherein the closure film (11) is configured to be torn apart or pierced when the sheet-material piercer (1) is moved from the first position to the second position by the actuation of the sheet-material piercer (1), thus enabling a substance to enter into the container (3) from the additional chamber (12), and wherein the sheet-material piercer (1) and the push-pull closure (6) are displaceable independently from one another on the cover part (5) and the sheet-material piercer (1) can be positioned in sealing and latching manner in the cover part (5) via the at least one sealing formation (16, 17, 18) so that the at least one sealing formation (16, 17, 18) is in sealing contact with the cover part (5) when the sheet-material piercer (1) is in the first position or the second position or in another position between the first position and the second position.

2. The container closure (2) according to claim 1, wherein the piercing end (14) of the sheet-material piercer (1) is substantially a bevelled plate (15).

3. The container closure (2) according to claim 1, wherein the container closure (2) is provided with latching means for receiving the at least one sealing formation (16, 17, 18) of the sheet-material piercer.

4. The container closure (2) according to claim 3, wherein the latching means are configured for sealing and latchable contact with the sheet-material piercer (1), wherein the sealing and latchable contact is provided by the latching means in the first position of the sheet-material piercer (1) and in the second position of the sheet-material piercer (1).

5. The container closure (2) according to claim 3, wherein the latching means are circular grooves, webs or steps.

6. The container closure (2) according to claim 1, wherein three circular sealing formations (16, 17, 18) are provided on the sheet-material piercer (1).

7. The container closure (2) according to claim 6, wherein two circular sealing formations (16, 17) having the same circle diameters are provided on the sheet-material piercer (1).

8. The container closure (2) according to claim 6, wherein the circular sealing formations (16, 17, 18) provided on the sheet-material piercer (1) are plate-like.

* * * * *

UNITED STATES PATENT AND TRADEMARK OFFICE

CERTIFICATE OF CORRECTION

PATENT NO. : 8,479,943 B2
APPLICATION NO. : 12/734265
DATED : July 9, 2013
INVENTOR(S) : Wilhelm It is certified that error appears in the above-identified patent and that said Letters Patent is hereby corrected as shown below:

In the Claims:

In particular, in Column 5, line 4 (line 25 of Claim 1) after the word "from" please insert: --a--.

Signed and Sealed this
Twenty-seventh Day of August, 2013

Teresa Stanek Rea
*Acting Director of the United States Patent and Trademark Office*